US009267311B2

(12) United States Patent
Huang et al.

(10) Patent No.: US 9,267,311 B2
(45) Date of Patent: Feb. 23, 2016

(54) LOCK STRUCTURE

(71) Applicant: TAIWAN FU HSING INDUSTRIAL CO., LTD., Kaohsiung (TW)

(72) Inventors: Chao-Ming Huang, Kaohsiung (TW); Wen-Chieh Lee, Kaohsiung (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 94 days.

(21) Appl. No.: 14/180,395

(22) Filed: Feb. 14, 2014

(65) Prior Publication Data

US 2014/0319858 A1 Oct. 30, 2014

(30) Foreign Application Priority Data

Apr. 24, 2013 (TW) ..... 102114506 A

(51) Int. Cl.

| | |
|---|---|
| ***E05B 15/02*** | (2006.01) |
| ***E05B 15/00*** | (2006.01) |
| ***E05B 3/00*** | (2006.01) |
| *E05B 1/00* | (2006.01) |
| *E05B 9/00* | (2006.01) |

(52) U.S. Cl.

CPC ..... *E05B 3/003* (2013.01); *E05B 15/0053* (2013.01); *E05B 15/02* (2013.01); *E05B 1/00* (2013.01); *E05B 1/003* (2013.01); *E05B 1/0007* (2013.01); *E05B 3/00* (2013.01); *E05B 2009/006* (2013.01); *Y10T 292/91* (2015.04)

(58) Field of Classification Search

CPC ..... E05B 1/00; E05B 1/0007; E05B 1/003; E05B 3/00; E05B 3/06; E05B 15/02

USPC ..... 292/347, 348, 357

See application file for complete search history.

(56) References Cited

U.S. PATENT DOCUMENTS

| | | | | | |
|---|---|---|---|---|---|
| 1,519,500 | A | * | 12/1924 | Miller | 292/356 |
| 1,519,503 | A | * | 12/1924 | Norwood et al. | 292/356 |
| 1,878,394 | A | * | 9/1932 | Haan, Jr | 292/347 |
| 2,707,649 | A | * | 5/1955 | Young | 292/348 |
| 3,044,817 | A | * | 7/1962 | Marcante | 292/336.3 |
| 4,869,083 | A | * | 9/1989 | DeMarseilles et al. | 70/224 |

(Continued)

FOREIGN PATENT DOCUMENTS

| | | | |
|---|---|---|---|
| CN | 1782306 B | | 7/2011 |
| DE | 9405024 | * | 5/1994 |

(Continued)

OTHER PUBLICATIONS

Taiwanese Office Action mailed Jan. 28, 2015 for Taiwanese Patent Application No. 102114506, 3 pages.

*Primary Examiner* — Carlos Lugo

(74) *Attorney, Agent, or Firm* — Jackson IPG PLLC; Demian K. Jackson

(57) ABSTRACT

A lock structure includes a mounting plate, a positioning member, an escutcheon and a constraining member, wherein the mounting plate comprises a ring wall, guiding slot and a limiting slot, and the escutcheon comprises a limiting protrusion. The positioning member is disposed in the limiting slot and clamped between the escutcheon and the constraining member. The limiting protrusion penetrates the guiding slot of the escutcheon and is constrained inside the limiting slot. The limiting protrusion of the escutcheon is blockable by the constraining member to prevent the rotating escutcheon from separation from the mounting plate.

17 Claims, 15 Drawing Sheets

(56) References Cited

U.S. PATENT DOCUMENTS

| | | | | |
|---|---|---|---|---|
| 5,666,833 | A * | 9/1997 | Gao et al. | 70/224 |
| 5,727,406 | A * | 3/1998 | Banducci | 70/224 |
| 6,048,007 | A * | 4/2000 | Shor | 292/348 |
| 6,223,572 | B1 * | 5/2001 | Marttinen | 70/370 |
| 6,880,872 | B2 | 4/2005 | Eller et al. | |
| 7,073,829 | B2 * | 7/2006 | Kuo et al. | 292/357 |
| 8,087,272 | B1 * | 1/2012 | Korban | 70/224 |
| 8,235,431 | B2 * | 8/2012 | Williamson | 292/357 |
| 8,746,760 | B2 * | 6/2014 | Chen et al. | 292/357 |
| 2002/0059696 | A1 | 5/2002 | Nakasone et al. | |
| 2002/0096893 | A1 * | 7/2002 | Wu | 292/347 |
| 2005/0184538 | A1 * | 8/2005 | Huang et al. | 292/336.3 |
| 2015/0069769 | A1 * | 3/2015 | Chen | 292/357 |

FOREIGN PATENT DOCUMENTS

| | | | |
|---|---|---|---|
| DE | 102006006957 | A1 * | 8/2007 |
| DE | 202011000933 | U1 * | 9/2011 |
| GB | 684044 | * | 12/1952 |
| TW | 175152 | | 12/1991 |
| TW | M286207 | | 1/2006 |
| TW | M409282 | | 8/2011 |

* cited by examiner

LOCK STRUCTURE

FIELD OF THE INVENTION

The present invention is generally related to a lock structure, which particularly relates to the lock structure preventing an escutcheon from separation from a mounting plate and avoiding a transmission tube from damage by an external force. The lock structure failed in operation is avoidable.

BACKGROUND OF THE INVENTION

A conventional lock structure 10 in FIG. 1 comprises a handle 11, an escutcheon 12 and a mounting plate 13 covered with the escutcheon 12, wherein the mounting plate 13 comprises a longitudinal slot 13*a* and a transverse slot 13*b*, and the escutcheon 12 comprises a protrusion 12*a*. The protrusion 12*a* is rotatable in a first direction via the longitudinal slot 13*a* to make the protrusion 12*a* constrained inside the transverse slot 13*b*. The mounting plate 13 can not prevent the escutcheon 12 from rotating toward a second direction opposite to the first direction, once the escutcheon 12 rotates toward the second direction, the escutcheon 12 separates apart from the mounting plate 13 thereby causing the lock structure 10 to be damaged. Besides, a transmission tube (not shown in Figure) of the lock structure 10 is driven to rotate by the handle 11 and actuates a transmission mechanism (not shown in Figure). Once the handle 11 is collided by an external force, the transmission tube and the transmission mechanism are deformed by compression of the handle 11. Thus, the lock structure 10 has failed in operation.

SUMMARY

The primary object of the present invention is to provide a lock structure, wherein a limiting protrusion of an escutcheon is constrained inside a limiting slot of a mounting plate, and a constraining member prevents the rotating escutcheon from separation from the mounting plate. Besides, by engaging a transmission tube with a sleeve via an engaging member, the transmission tube and the sleeve are rotatable simultaneously. When the sleeve is damaged by an external force, the lock structure prevents the transmission tube from destruction in order that the lock structure failed in operation is avoidable.

The lock structure of the present invention includes a mounting plate, a positioning member, an escutcheon and a constraining member. The mounting plate comprises a ring wall, a guiding slot and a limiting slot communicated with the guiding slot, wherein the guiding slot and the limiting slot are formed at the ring wall, and the positioning member is disposed in the limiting slot and comprises at least one positioning slot. The escutcheon covers the mounting plate and comprises a limiting protrusion, wherein the limiting protrusion passes through the guiding slot of the mounting plate and enters the limiting slot. The escutcheon within the limiting slot is rotatable toward a first direction so as to enter the at least one positioning slot therefore making the limiting protrusion constrained by the limiting slot of the mounting plate and the at least one positioning slot of the positioning member. The positioning member is clamped between the mounting plate and the constraining member. The limiting protrusion of the escutcheon is blockable by the constraining member so as to limit the escutcheon from rotation toward a second direction opposite to the first direction.

The lock structure of the present invention further includes a sleeve, a transmission tube and an engaging member, wherein the sleeve comprises a receiving hole, and the transmission tube penetrates inside the receiving hole. The transmission tube is engaged with the sleeve via the engaging member so as to make the sleeve and the transmission tube rotatable simultaneously.

In this invention, the limiting protrusion is blockable by the constraining member to prevent the rotating escutcheon from separation from the mounting plate. Further, simultaneous rotation of the sleeve and the transmission tube is achieved by the engaging member. When the lock structure is collided by the external force, the external force merely damages the sleeve. Therefore, the damage of the transmission tube is avoidable.

DETAILED DESCRIPTION OF THE INVENTION

Figure 1:
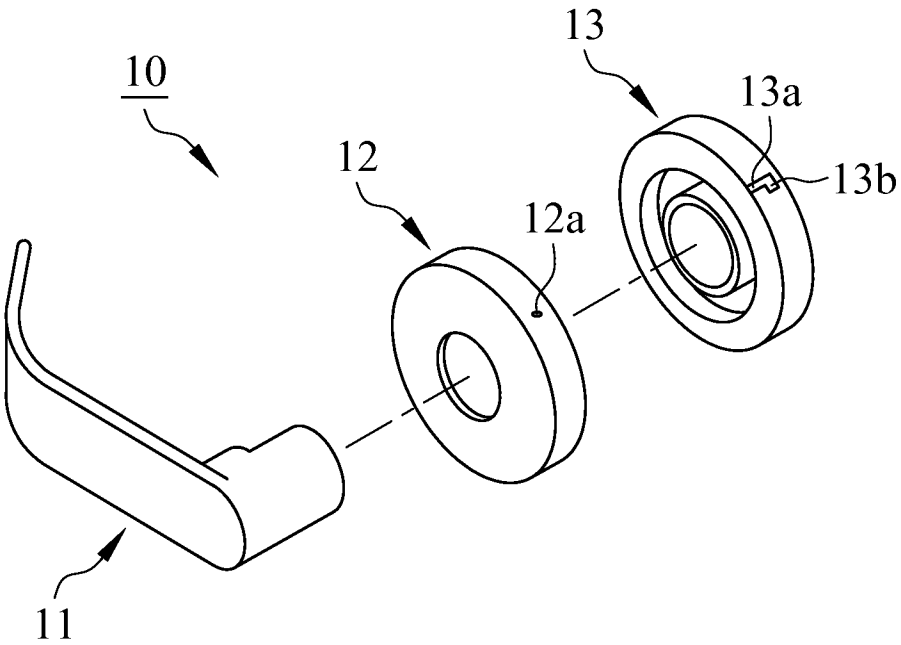
FIG. 1 PRIOR ART
FIG. 1 is a perspective exploded diagram illustrating a conventional lock structure.
Figure 2:
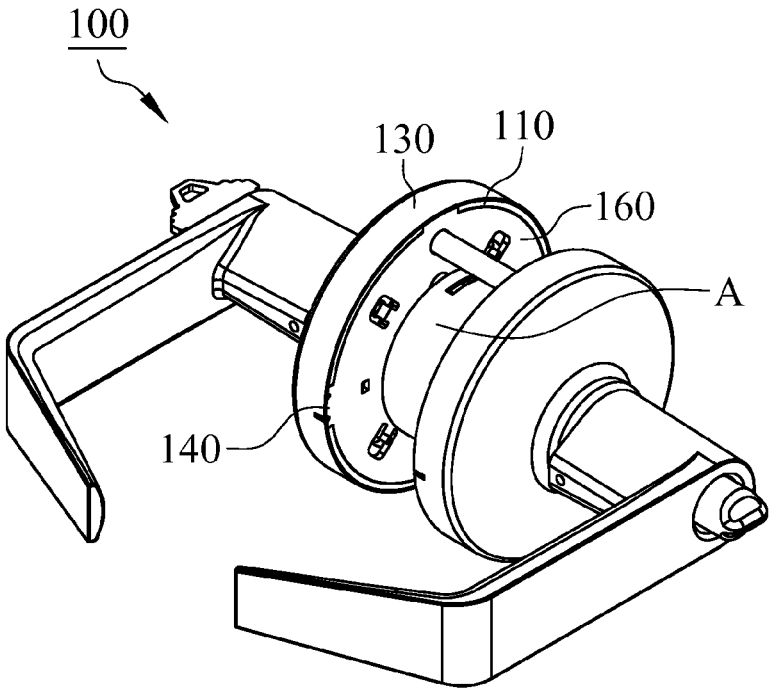
FIG. 2 is a perspective diagram illustrating a lock structure in accordance with a first embodiment of the present invention.
Figure 3:
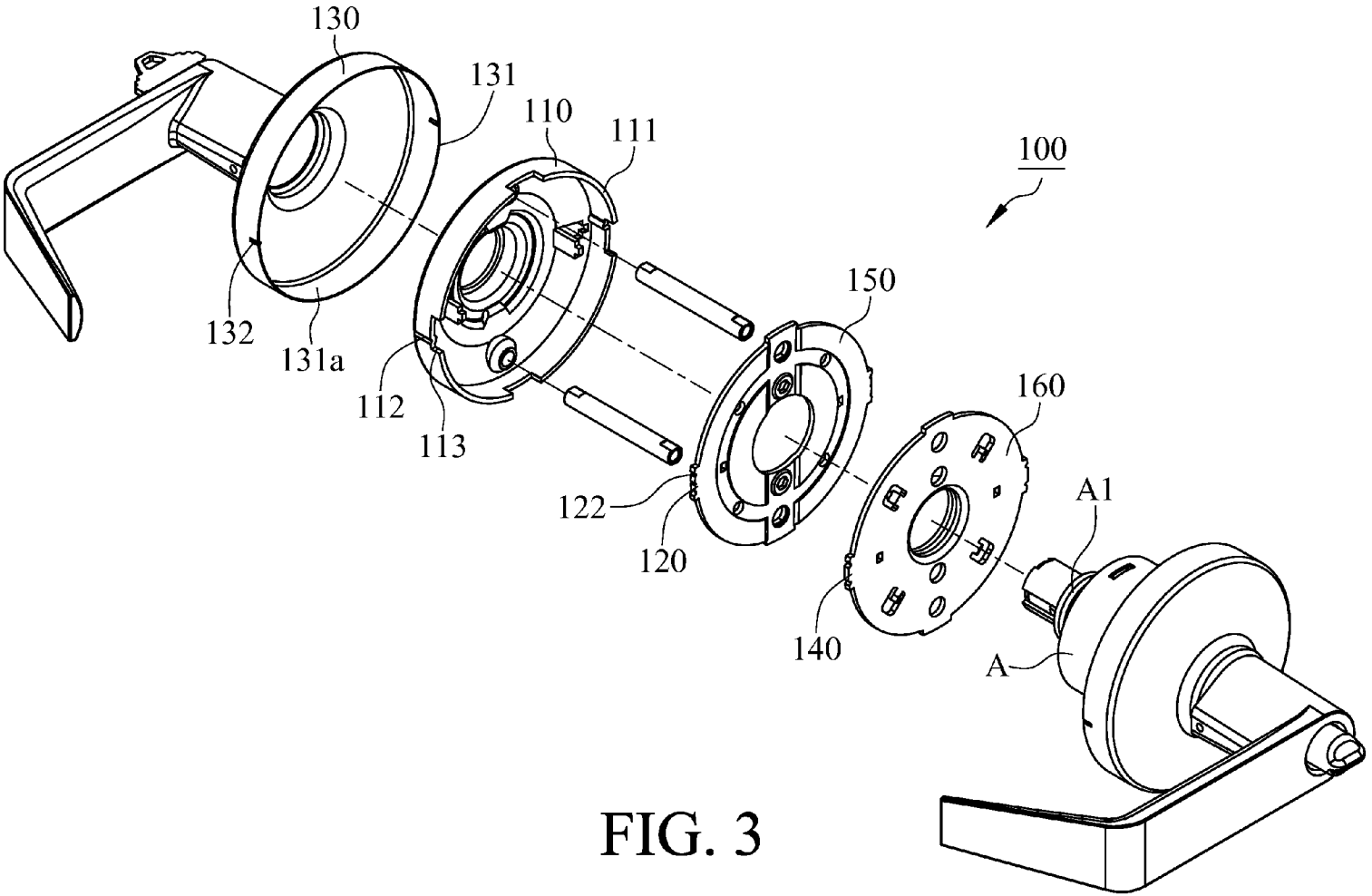
FIG. 3 is a perspective exploded diagram illustrating the lock structure in accordance with the first embodiment of the present invention.
Figure 4:
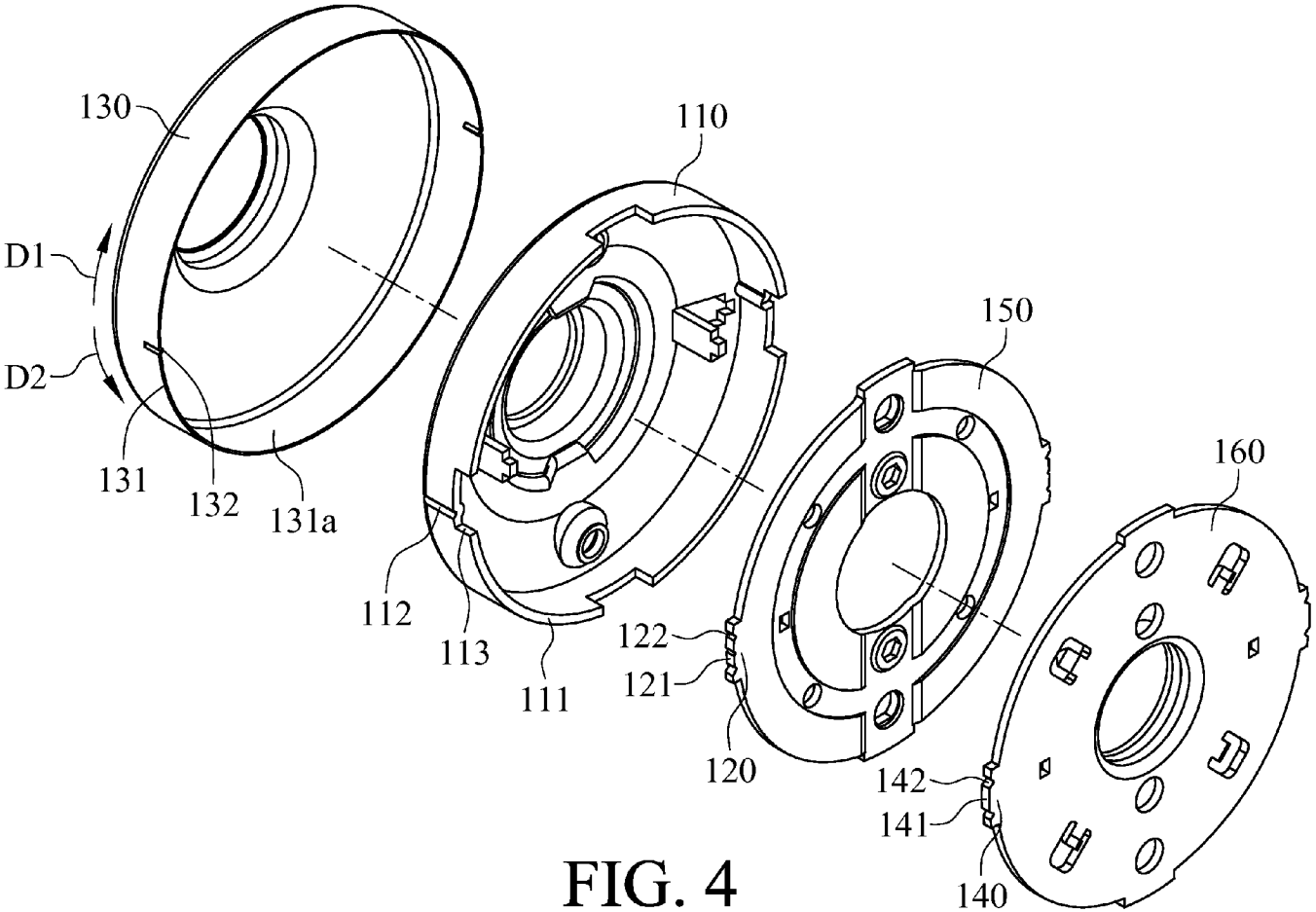
FIG. 4 is a perspective exploded diagram illustrating the lock structure in accordance with the first embodiment of the present invention.

With reference to FIGS. 2, 3 and 4, a lock structure 100 in accordance with a first embodiment of the present invention includes a mounting plate 110, a positioning member 120, an escutcheon 130, a constraining member 140, a positioning plate 150, a constraining plate 160 and a main body A. The main body A penetrates through an installation hole of a door and connects to a handle at an interior side of the door (such as a handle at the right side in FIG. 3) and a handle at exterior side of the door (such as a handle at the left side in FIG. 3) simultaneously. By spinning the handle, a latch is driven to unlatch by a retractor inside the main body A.

Figure 9:
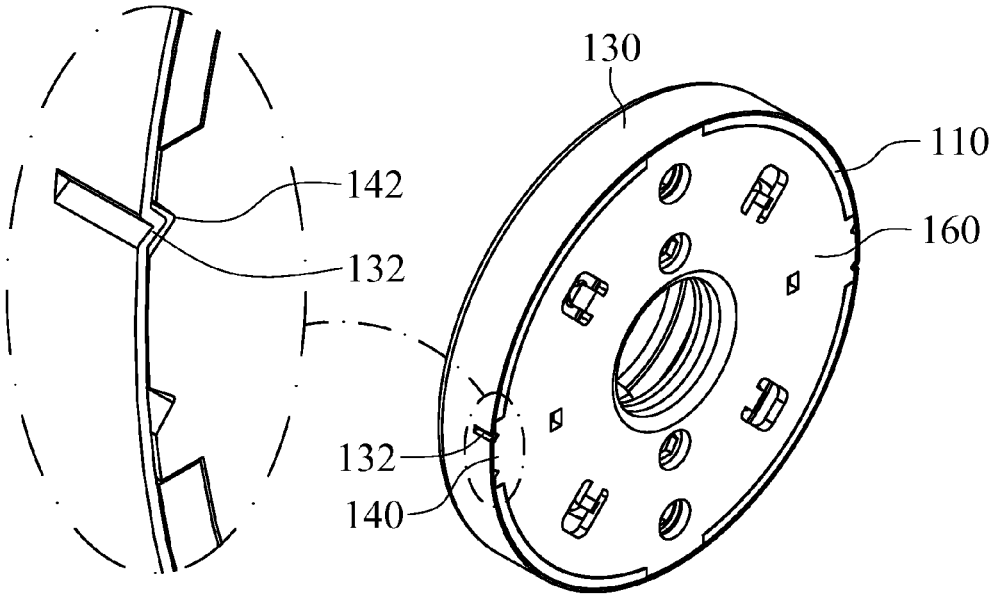
FIG. 9 is a perspective assembly diagram illustrating the lock structure in accordance with the first embodiment of the present invention.

With reference to FIGS. 2, 4 and 9, in this embodiment, the positioning member 120 is formed at the positioning plate 150, the constraining member 140 is formed at the constraining plate 160, and the positioning plate 150 is constrained between the mounting plate 110 and the constraining plate 160. The escutcheon 130 covers the mounting plate 110.

Referring to FIGS. 3 and 4, the mounting plate 110 comprises a ring wall 111, a guiding slot 112 and a limiting slot 113 communicated with the guiding slot 112, wherein the guiding slot 112 and the limiting slot 113 are formed at the ring wall 111. In this embodiment, the guiding slot 112 is a longitudinal slot, and the limiting slot 113 is a transverse slot and penetrates the ring wall 111.

Figure 5:
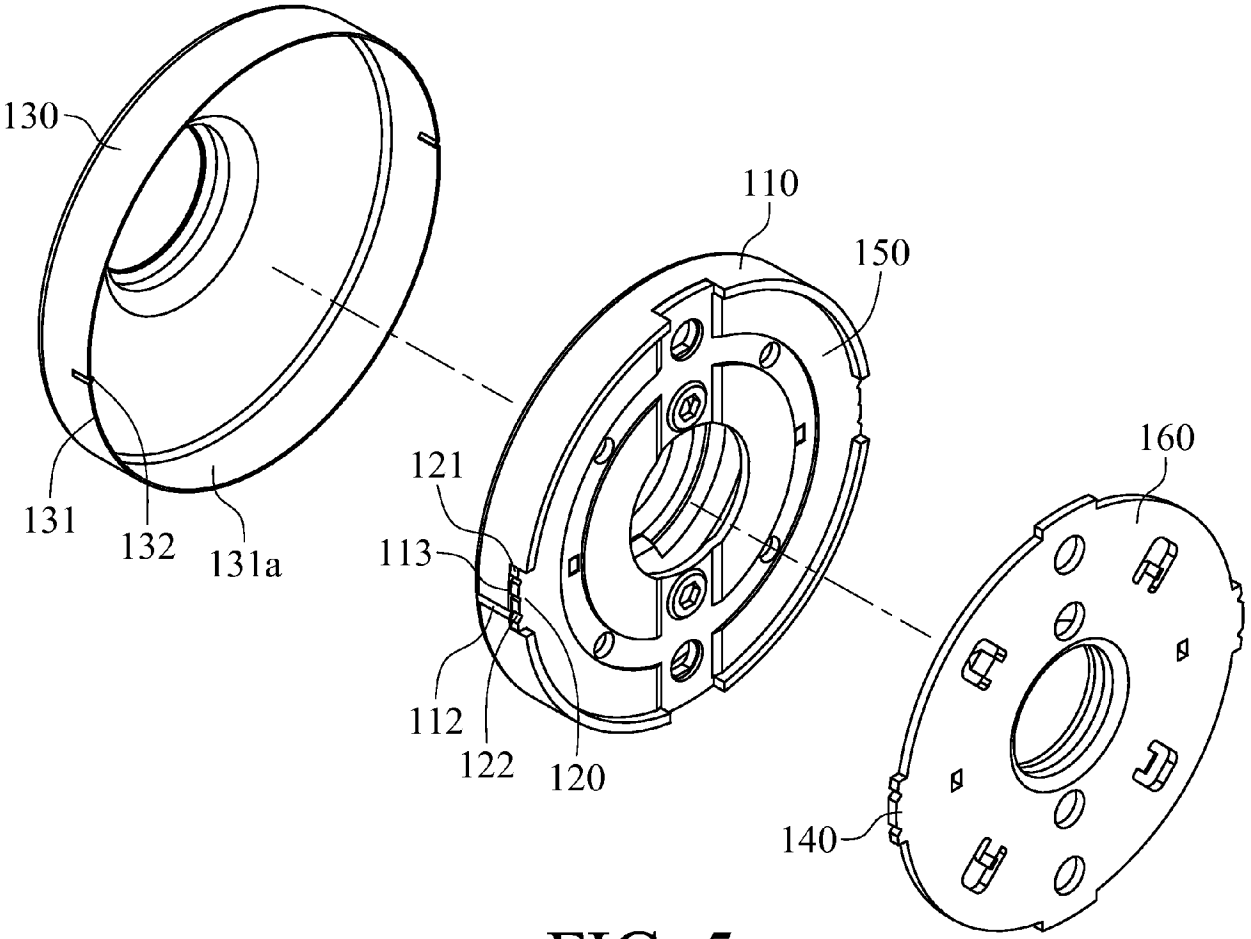
FIG. 5 is a perspective exploded diagram illustrating the lock structure in accordance with the first embodiment of the present invention.

With reference to FIG. 5, the positioning plate 150 is engaged with the mounting plate 110. In this embodiment, the mounting plate 110 covers the positioning plate 150, the positioning member 120 is disposed in the limiting slot 113, and the positioning member 120 is revealed by the limiting slot 113. The positioning member 120 comprises a first surface 121 and at least one positioning slot 122 recessed from the first surface 121.

Referring to FIGS. 3 and 4, the escutcheon 130 comprises a lateral wall 131 and a limiting protrusion 132, wherein the lateral wall 131 covers the ring wall 111 and comprises an inner surface 131*a* facing toward the ring wall 111, and the limiting protrusion 132 is protruded to the inner surface 131*a*.

Figure 6:
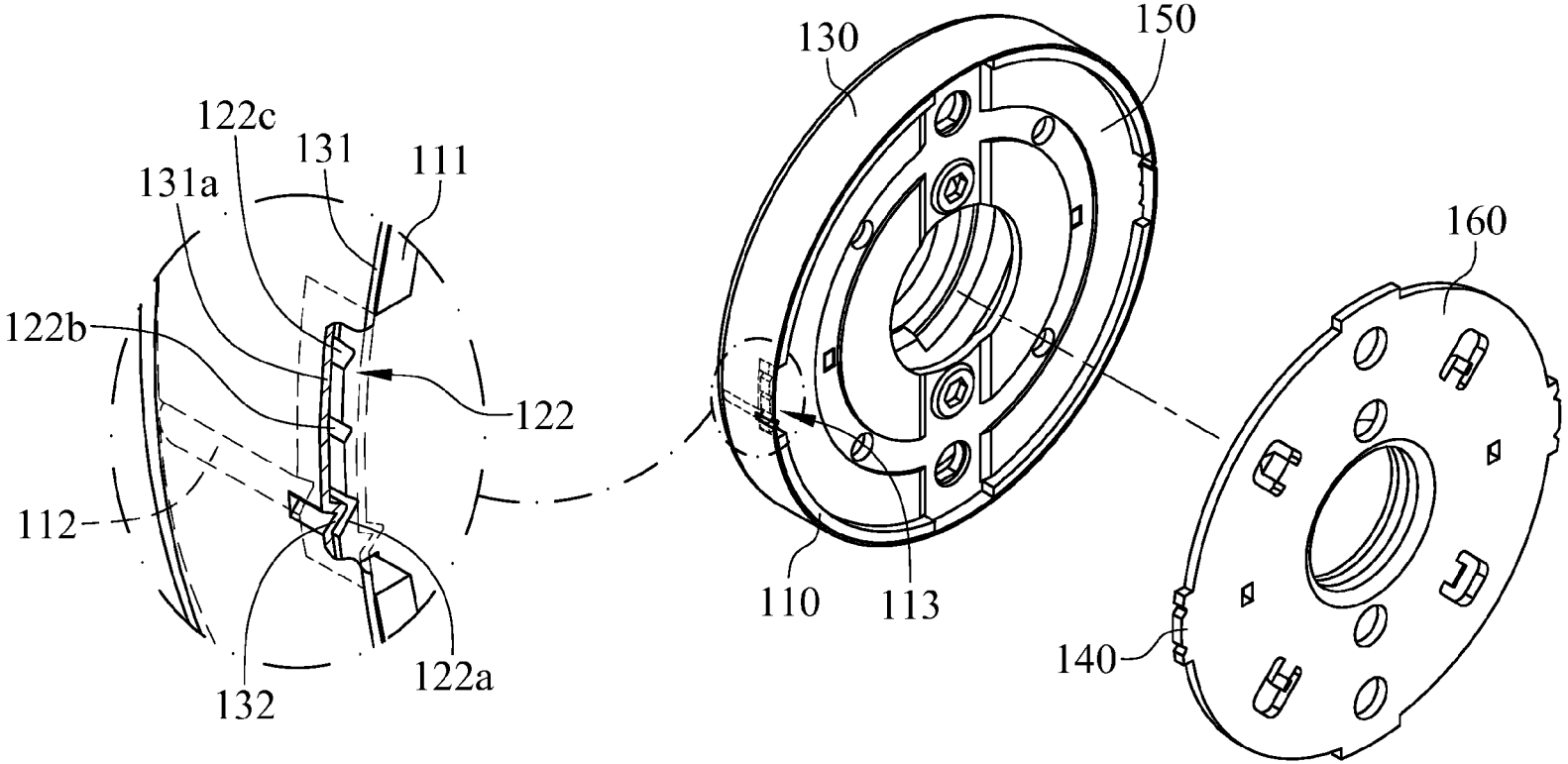
FIG. 6 is a perspective exploded diagram illustrating the lock structure in accordance with the first embodiment of the present invention.
Figure 7:
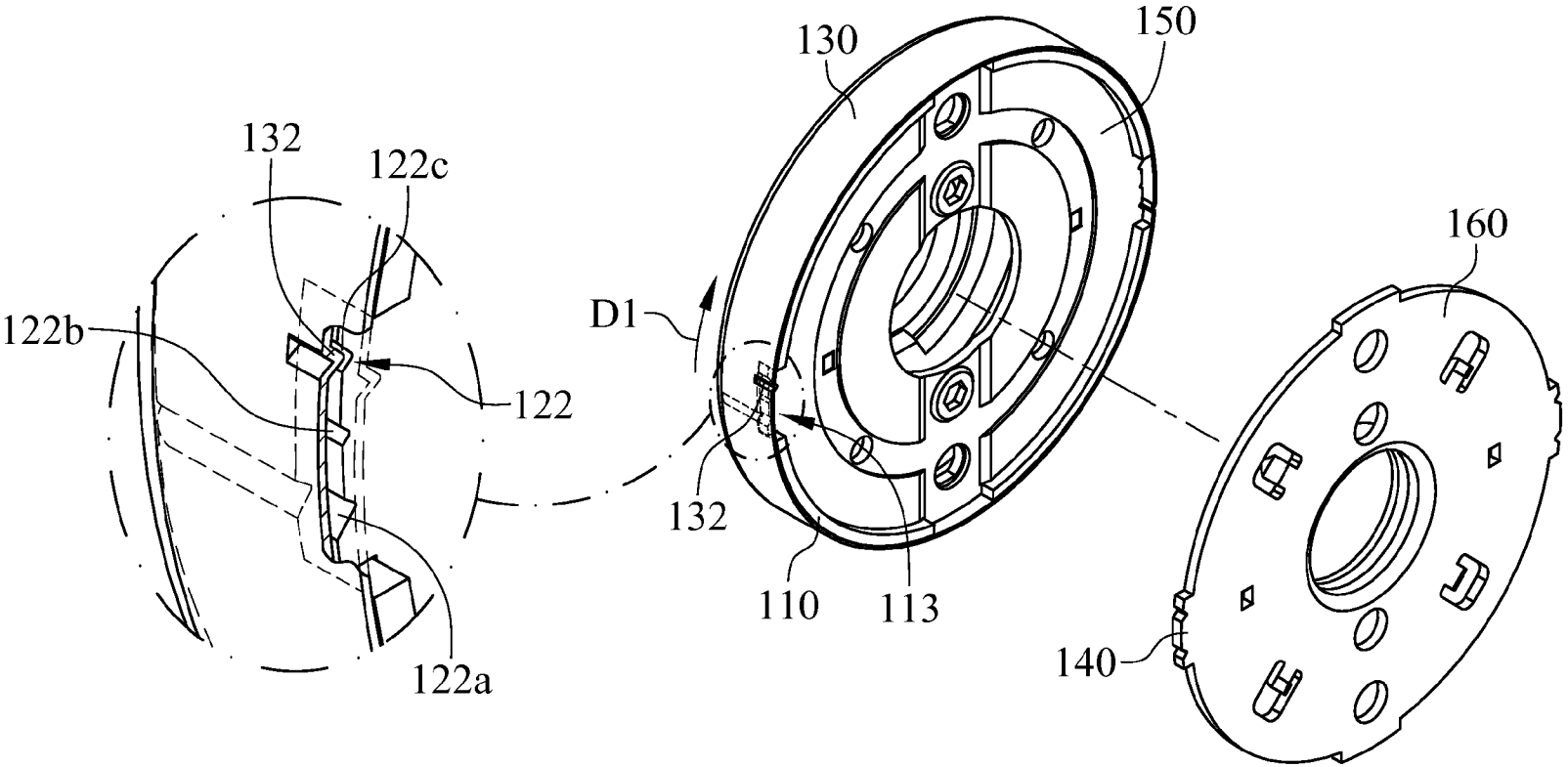
FIG. 7 is a perspective exploded diagram illustrating the lock structure in accordance with the first embodiment of the present invention.

With reference to FIG. 6, the escutcheon 130 covers the mounting plate 110, and the limiting protrusion 132 of the escutcheon 130 passes through the guiding slot 112. Referring to FIG. 7, when the limiting protrusion 132 of the escutcheon 130 passes through the guiding slot 112 to enter the limiting slot 113, the limiting protrusion 132 of the escutcheon 130 in the limiting slot 113 is rotatable toward a first direction D1 to make the limiting protrusion 132 enter the positioning slot 122 so that the limiting protrusion 132 is constrained in the limiting slot 113 to prevent the escutcheon 130 from axial separation from the mounting plate 110. When the limiting protrusion 132 is rotated toward the first direction D1, the limiting protrusion 132 is constrained by one certain positioning slot 122 of the positioning member 120. In this embodiment, the first direction D1 is clockwise.

Figure 8:
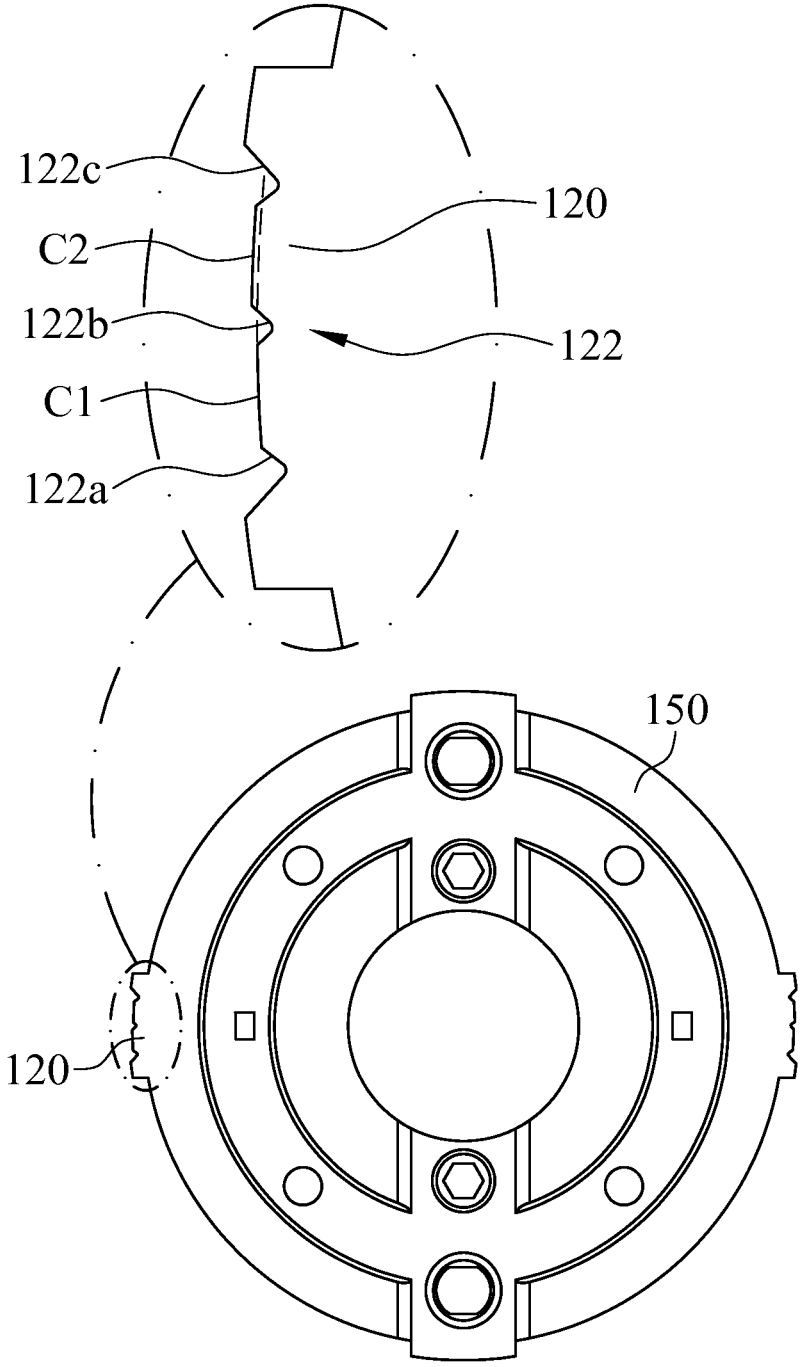
FIG. 8 is a front view illustrating a positioning member and a positioning plate in accordance with the first embodiment of the present invention.

With reference to FIGS. 6, 7 and 8, in this embodiment, the quantity of the positioning slot 122 of the positioning member 120 is three, that is to say, the positioning member 120 comprises a first positioning slot 122*a*, a second positioning slot 122*b* and a third positioning slot 122*c*, and the second positioning slot 122*b* is located between the first positioning slot 122*a* and the third positioning slot 122*c*. A first curved surface C1 is located between the first positioning slot 122*a* and the second positioning slot 122*b*, and a second curved surface C2 is located between the second positioning slot 122*b* and the third positioning slot 122*c*. When the limiting protrusion 132 of the escutcheon 130 in the limiting slot 113 is rotated toward the first direction D1, the limiting protrusion 132 passes through the first positioning slot 122*a*, the first curved surface C1, the second positioning slot 122*b*, the second curved surface C2 and the third positioning slot 122*c* sequentially so that the limiting protrusion 132 is constrained inside the third positioning slot 122*c*. Owning to the first curved surface C1 lower than the second curved surface C2, the condition the limiting protrusion 132 passing through the second curved surface C2 becomes more restricted and more difficult to rotate comparing with the condition the limiting protrusion 132 passing through the first curved surface C1. By gradual tightening of the positioning member 120, the limiting protrusion 132 is thereby constrained within the third positioning slot 122*c*.

Referring to FIG. 9, the constraining plate 160 is engaged with the mounting plate 110 to make the positioning plate 150 constrained between the mounting plate 110 and the constraining plate 160. In this embodiment, the constraining member 140 is disposed in the limiting slot 113, and the positioning member 120 is clamped between the mounting plate 110 and the constraining member 140. The limiting protrusion 132 of the escutcheon 130 is blockable by the constraining member 140 to limit the escutcheon 130 from rotating toward a second direction D2 opposite to the first direction D1 so as to prevent the escutcheon 130 from separation from the mounting plate 110.

With reference to FIGS. 4 and 9, the constraining member 140 comprises a second surface 141 facing toward the inner surface 131*a* of the escutcheon 130 and a constraining slot 142 recessed from the second surface 141, wherein the limiting protrusion 132 of the escutcheon 130 is constrained within the constraining slot 142 of the constraining member 140.

Figure 10:
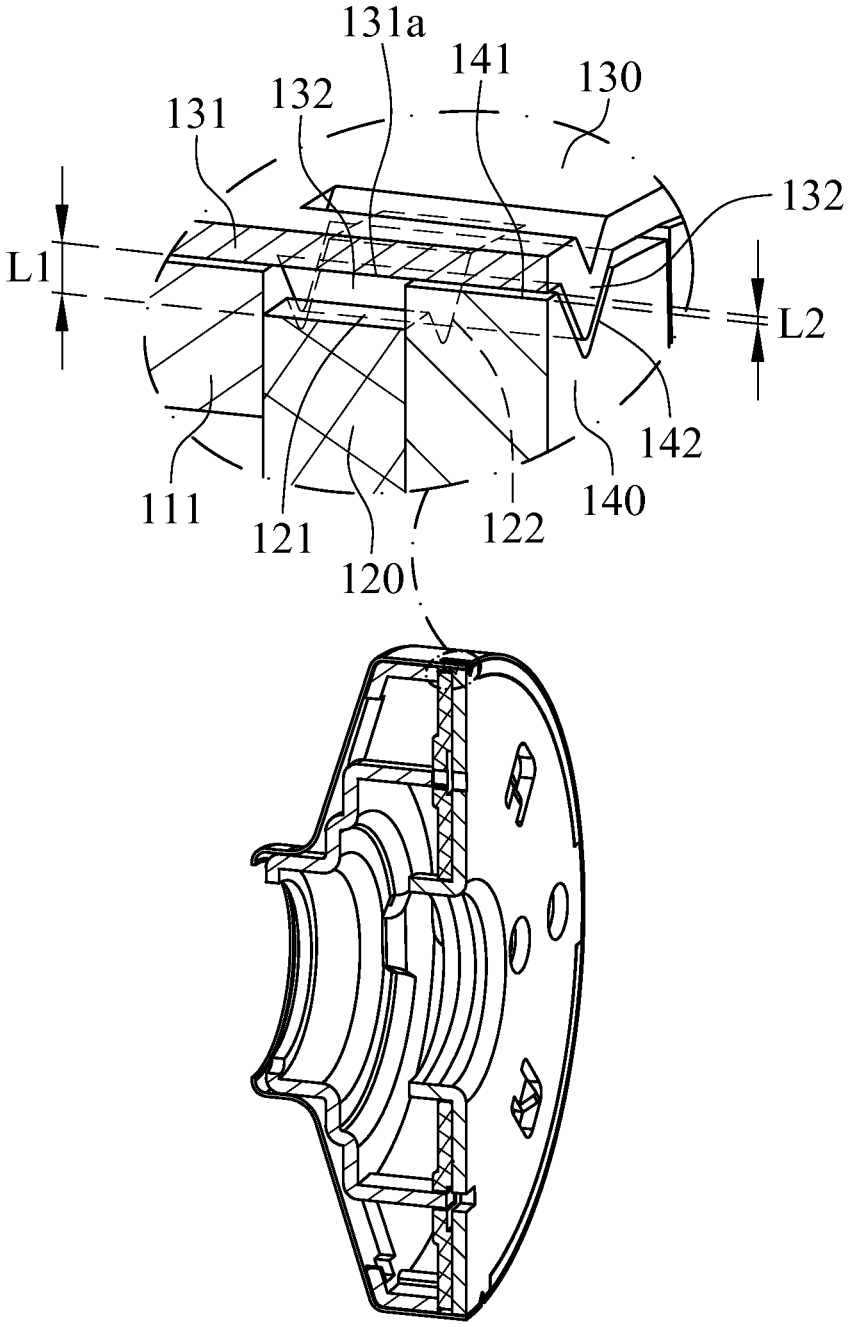
FIG. 10 is a perspective section diagram of FIG. 9 in a rotation of 90 degrees.

With reference to FIG. 7, when the escutcheon 130 is rotatable toward the first direction D1, the limiting protrusion 132 is constrained inside the positioning slot 122. However, the escutcheon 130 is still rotatable toward the second direction D2 to separate from the mounting plate 110. Referring to FIG. 9, the limiting protrusion 132 of the escutcheon 130 is constrained by the constraining member 140 to prevent the escutcheon 130 from rotating toward the second direction D2. Referring to FIG. 10, preferably, in this embodiment, a first interval L1 is defined between the first surface 121 of the positioning member 120 and the inner surface 131*a* of the lateral wall 131, and a second interval L2 is defined between the second surface 141 of the constraining member 140 and the inner surface 131*a* of the lateral wall 131. The second interval L2 is smaller than the first interval L1. The limiting protrusion 132 is constrained inside the constraining slot 142 of the constraining member 140, owing to the second interval L2 smaller than the first interval L1, the escutcheon 130 is not able to rotate toward the second direction D2. Relatively, the limiting protrusion 132 of the escutcheon 130 is also constrained inside the limiting slot 113 of the mounting plate 110 to prevent the escutcheon 130 from separation from the mounting plate 110.

Figure 12:
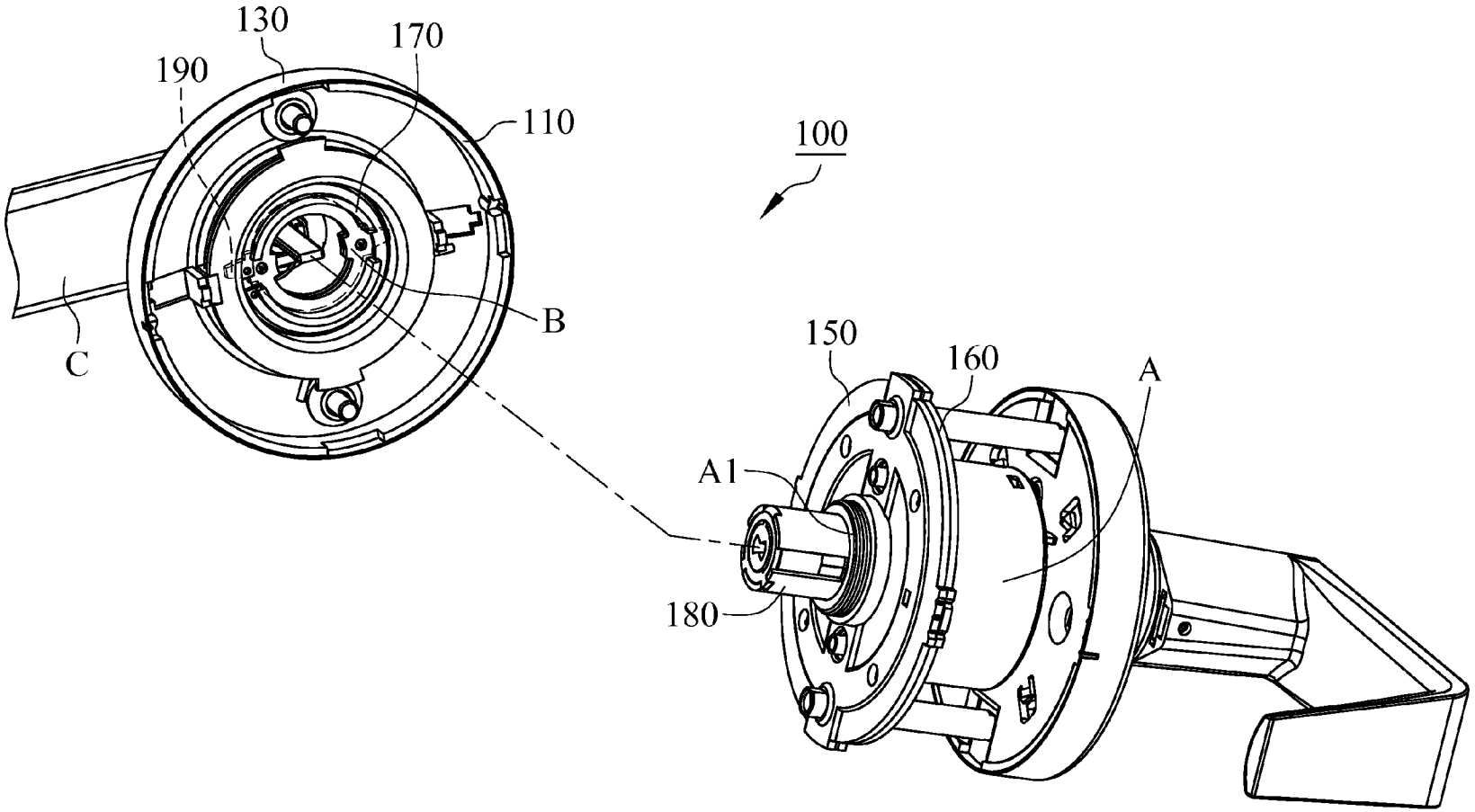
FIG. 12 is a perspective exploded diagram illustrating the lock structure in accordance with the first embodiment of the present invention.

With reference to FIGS. 3 and 12, in this embodiment, preferably, the main body A comprises a thread portion A1, wherein the constraining plate 160 is screwed by the thread portion A1 of the main body A. The position that the constraining plate 160 is screwed by the thread portion A1 is adjustable to make the lock structure 100 applicable to various thicknesses of doors (not shown in Figure).

Figure 11:
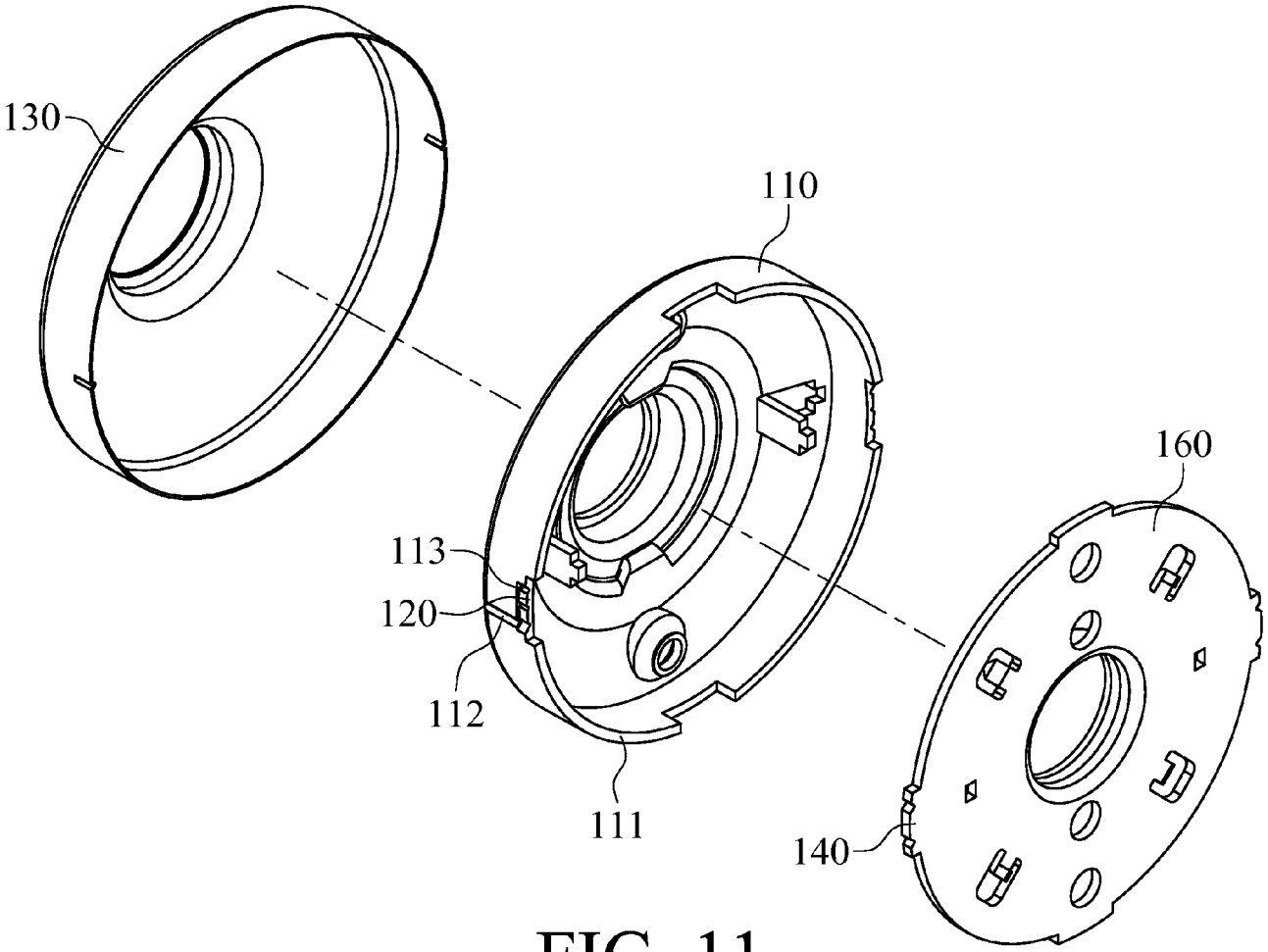
FIG. 11 is a perspective exploded diagram illustrating the lock structure in accordance with a second embodiment of the present invention.

FIG. 11 is a perspective exploded diagram in accordance with a second embodiment of the present invention. The primary difference between the second embodiment and the first embodiment is that the positioning member 120 is formed inside the limiting slot 113 of the escutcheon 110, and the positioning member 120 is integrally formed as one piece with the mounting plate 110. Accordingly, there is no positioning plate 150 in the second embodiment, and the time for assembling the lock structure 100 is reduced.

Figure 13:
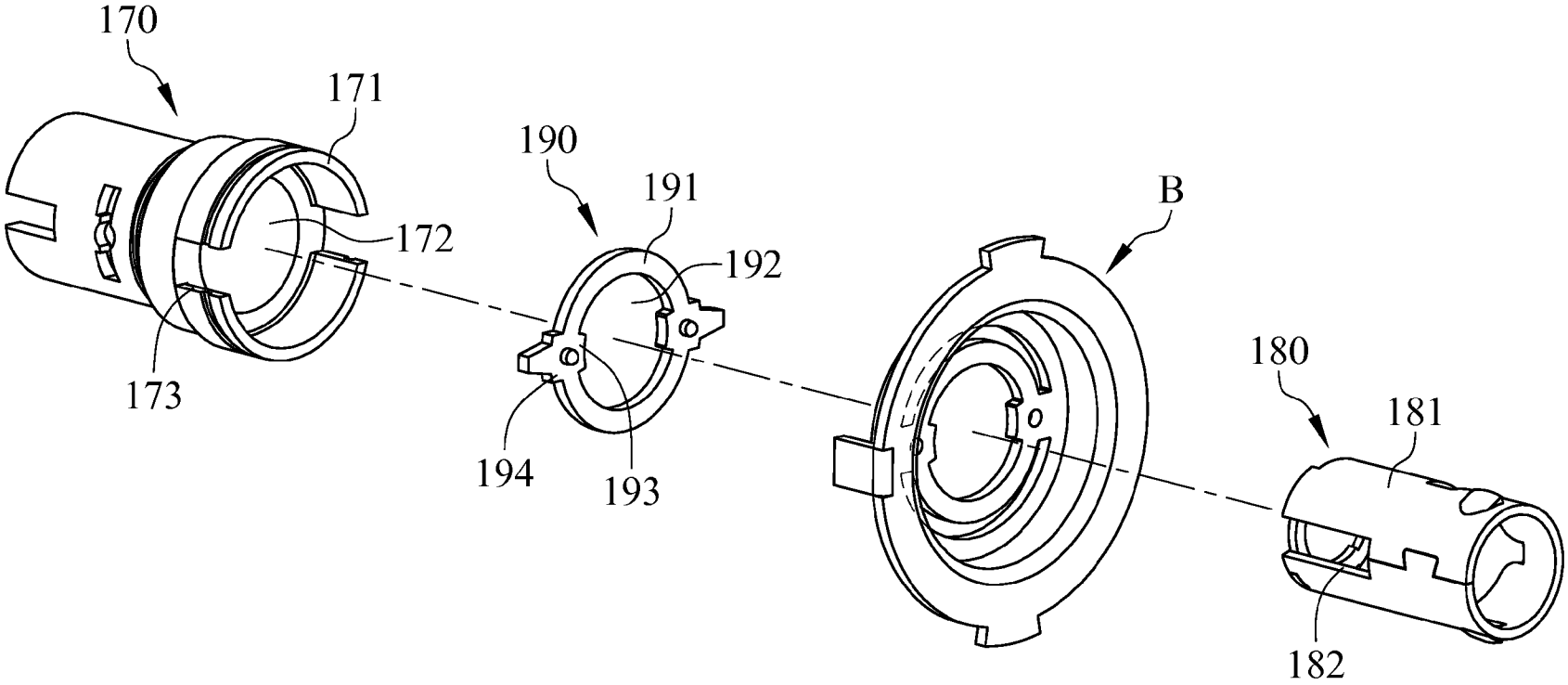
FIG. 13 is a perspective exploded diagram illustrating a sleeve, an engaging member, a transmission tube and an actuation plate in accordance with the first embodiment of the present invention.
Figure 14:
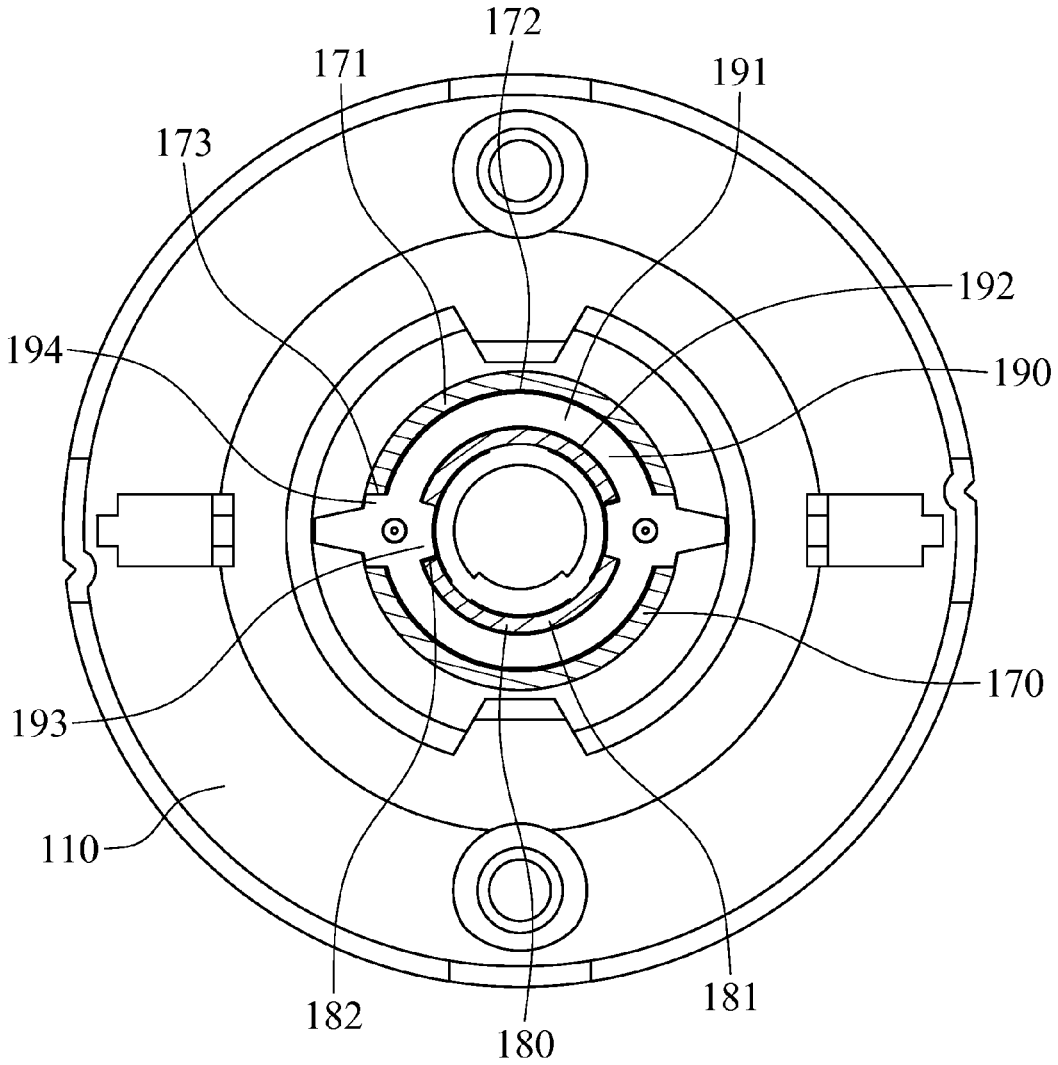
FIG. 14 is a section view illustrating the sleeve, the engaging member and the transmission tube in accordance with the first embodiment of the present invention.

Referring to FIGS. 12, 13 and 14, in the first embodiment of the present invention, the lock structure 100 further includes a sleeve 170, a transmission tube 180, an engaging member 190, an actuation plate B and a handle assembly C. With reference to FIGS. 12 and 13, the sleeve 170 engages with the handle assembly C and comprises a sleeve body 171, a receiving hole 172 and a restricting slot 173. The receiving hole 172 is surrounded by the sleeve body 171, and the restricting slot 173 is formed at the sleeve body 171 and communicates with the receiving hole 172. The transmission tube 180 is engaged with the main body A and comprises a tube body 181 and an engaging slot 182 formed at the tube body 181. The transmission tube 180 is penetrated inside the receiving hole 172.

With reference to FIGS. 12 and 13, the engaging member 190 is engaged with the handle assembly C and concealed by the actuation plate B. The engaging member 190 comprises a body portion 191, a penetrating hole 192, an interior protrusion 193 and an exterior protrusion 194, wherein the penetrating hole 192 is surrounded by the body portion 191, the interior protrusion 193 is disposed at the body portion 191 and located in the penetrating hole 192, and the exterior protrusion 194 is protruded to the body portion 191.

With reference to FIG. 14, in this embodiment, the engaging member 190 is disposed in the receiving hole 172, and the exterior protrusion 194 of the engaging member 190 is accommodated in the restricting slot 173. The tube body 181 of the transmission tube 180 is penetrated through the penetrating hole 192 of the engaging member 190, and the interior protrusion 193 of the engaging member 190 is accommodated in the engaging slot 182. The transmission tube 180 is engaged with the sleeve 170 via the engaging member 190 and the actuation plate B to make the sleeve 170 and the transmission tube 180 rotatable simultaneously.

Figure 15:
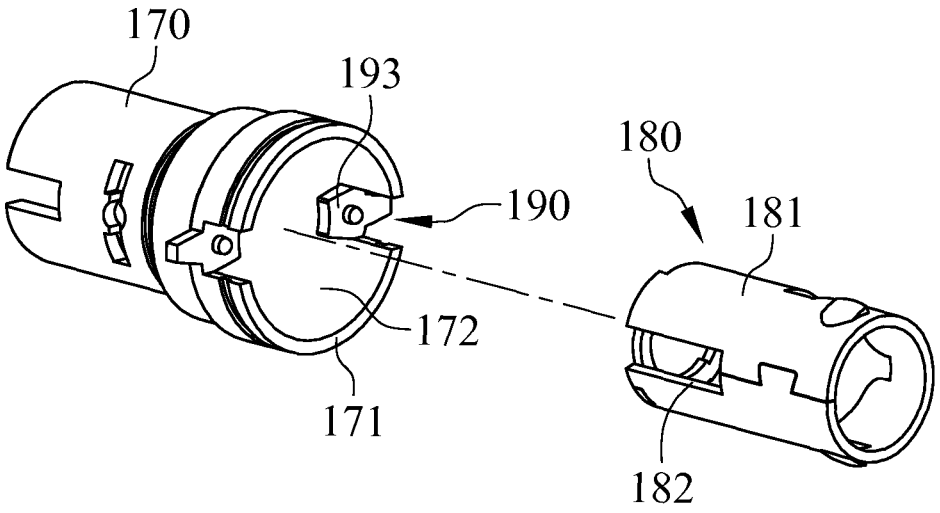
FIG. 15 is a perspective exploded diagram illustrating a sleeve and a transmission tube in accordance with a third embodiment of the present invention.

FIG. 15 is a perspective exploded diagram of the sleeve 170 and the transmission tube 180 in accordance with a third embodiment of the present invention. The primary difference between the third embodiment and the first embodiment is that the engaging member 190 does not possess the body portion 191 and the penetrating hole 192, the engaging member 190 is formed at the sleeve 170, and the engaging member 190 is integrally formed as one piece with the sleeve 170. In this embodiment, the interior protrusion 193 is located in the receiving hole 172. In common with the first embodiment, the interior protrusion 193 of the engaging member 190 is accommodated in the engaging slot 182, and the transmission tube 180 is engaged with the sleeve 170 via the engaging member 190 to make the sleeve 170 and the transmission tube 180 rotatable simultaneously.

Figure 16:
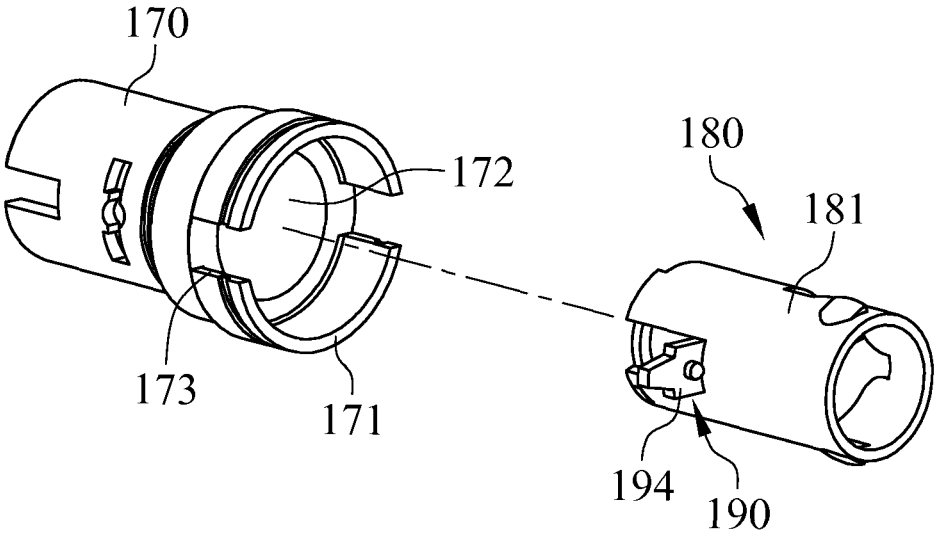
FIG. 16 is a perspective exploded diagram illustrating a sleeve and a transmission tube in accordance with a fourth embodiment of the present invention.

FIG. 16 is a perspective exploded diagram illustrating the sleeve 170 and the transmission tube 180 in accordance with a fourth embodiment of the present invention. The primary difference between the fourth embodiment and the first embodiment is that the engaging member 190 does not possess the body portion 191 and the penetrating hole 192, the engaging member 190 is formed at the transmission tube 180, and the engaging member 190 is integrally formed as one piece with the transmission tube 180. In this embodiment, the exterior protrusion 194 is protruded to the tube body 181. In common with the first embodiment, the exterior protrusion 194 of the engaging member 190 is accommodated in the restricting slot 173 of the sleeve 170, and the transmission tube 180 is engaged with the sleeve 170 via the engaging member 190 to make the sleeve 170 and the transmission tube 180 rotatable simultaneously.

In this invention, the limiting protrusion 132 is blockable by the constraining member 140 so as to prevent the rotating escutcheon 130 from separation from the mounting plate 110. In addition, by engaging the sleeve 170 with the transmission tube 180 via the engaging member 190, the sleeve 170 and the transmission tube 180 are rotatable simultaneously, that is to say, the combination of the sleeve 170 and the transmission tube 180 is a two-section structure. The two-section structure possesses features of uniform force exertion and better stress distribution. When the sleeve 170 is damaged by an external force, the two-section structure prevents the transmission tube 180 from being damaged to avoid failed operation of the lock structure 100.

While this invention has been particularly illustrated and described in detail with respect to the preferred embodiments thereof, it will be clearly understood by those skilled in the art that it is not limited to the specific features and describes and various modifications and changes in form and details may be made without departing from the spirit and scope of this invention.

What is claimed is:

1. A lock structure includes:

a mounting plate having a ring wall, a guiding slot and a limiting slot communicated with the guiding slot, wherein the guiding slot and the limiting slot are both formed at and are defined by the ring wall;

a positioning member disposed in the limiting slot and having at least one positioning slot;

an escutcheon covering the mounting plate and having a limiting protrusion, wherein the limiting protrusion passes through the guiding slot of the mounting plate to enter the limiting slot, and the limiting protrusion of the escutcheon in the limiting slot is rotatable to enter the positioning slot to make the limiting protrusion constrained inside the limiting slot of the mounting plate and the at least one positioning slot of the positioning member; and a constraining plate having a constraining member disposed in the limiting slot, wherein the positioning member is clamped between the mounting plate and the constraining member, and the limiting protrusion of the escutcheon is blockable by the constraining member to limit the escutcheon from rotation and a main body is engaged with the constraining plate.

2. The lock structure in accordance with claim 1, wherein the positioning member comprises a first surface, the at least one positioning slot is recessed from the first surface, the escutcheon comprises a lateral wall covering the ring wall of the mounting plate, the lateral wall comprises an inner surface facing toward the ring wall, the limiting protrusion is protruded to the inner surface, the constraining member comprises a second surface facing toward the inner surface of the escutcheon, wherein a first interval is defined between the first surface of the positioning member and inner surface of the lateral wall, and a second interval smaller than the first interval is defined between the second surface of the constraining member and the inner surface of the lateral wall.

3. The lock structure in accordance with claim 2, wherein the constraining member comprises a constraining slot recessed from the second surface, and the limiting protrusion of the escutcheon is constrained in the constraining slot.

4. The lock structure in accordance with claim 1 further includes a positioning plate, the positioning member is formed at the positioning plate, the mounting plate covers the position plate, and the positioning member is revealed by the limiting slot.

5. The lock structure in accordance with claim 1, wherein the positioning member comprises a first positioning slot, a second positioning slot and a third positioning slot, the second positioning slot is located between the first positioning slot and the third positioning slot, wherein a first curved surface is located between the first positioning slot and the second positioning slot, and a second curved surface is located between the second positioning slot and the third positioning slot, wherein the first curved surface is lower than the second curved surface.

6. The lock structure in accordance with claim 1, wherein the main body having a thread portion, and the constraining plate is screwed by the thread portion of the main body.

7. The lock structure in accordance with claim 1 further includes a handle assembly, a sleeve, an engaging member and a transmission tube, wherein the sleeve engages with the handle assembly and comprises a receiving hole, the transmission tube engages with the main body and penetrates inside the receiving hole, and the transmission tube is engaged with the sleeve via the engaging member to make the sleeve and the transmission tube rotate simultaneously.

8. The lock structure in accordance with claim 7, wherein the sleeve comprises a sleeve body and a restricting slot, the receiving hole is surrounded by the sleeve body, the restricting slot is formed at the sleeve body, the transmission tube comprises a tube body and an engaging slot formed at the tube body, the engaging member comprises a body portion, a penetrating hole, an interior protrusion and an exterior protrusion, wherein the penetrating hole is surrounded by the body portion, the interior protrusion is disposed at the body portion and located in the penetrating hole, the exterior protrusion is protruded to the body portion, the interior protrusion is accommodated within the engaging slot, and the exterior protrusion is accommodated within the restricting slot.

9. The lock structure in accordance with claim 1, wherein the positioning member is integrally formed as one piece with the mounting plate.

10. The lock structure in accordance with claim 5, wherein the limiting protrusion of the escutcheon is rotated toward a first direction via the first curved surface and the second curved surface sequentially to enter the positioning slot.

11. A lock escutcheon of lock structure includes:

a mounting plate having a ring wall, a guiding slot and a limiting slot communicated with the guiding slot, wherein the guiding slot and the limiting slot are both formed at and defined by the ring wall;

a positioning member disposed in the limiting slot and having at least one positioning slot;

an escutcheon covering the mounting plate and having a limiting protrusion, wherein the limiting protrusion passes through the guiding slot of the mounting plate to enter the limiting slot, and the limiting protrusion of the escutcheon in the limiting slot is rotatable to enter the positioning slot to make the limiting protrusion constrained inside the limiting slot of the mounting plate and the at least one positioning slot of the positioning member; and a constraining plate having a constraining member disposed in the limiting slot, wherein the positioning member is clamped between the mounting plate and the constraining member, and the limiting protrusion of the escutcheon is blockable by the constraining member to limit the escutcheon from rotation.

12. The lock escutcheon of lock structure in accordance with claim 11, wherein the positioning member is integrally formed as one piece with the mounting plate.

13. The lock escutcheon of lock structure in accordance with claim 11, wherein the positioning member is formed at a positioning plate, and the mounting plate covers the positioning plate.

14. The lock escutcheon of lock structure in accordance with claim 11, wherein the positioning member comprises a first surface, the at least one positioning slot is recessed from the first surface, the escutcheon comprises a lateral wall covering the ring wall of the mounting plate, the lateral wall comprises an inner surface facing toward the ring wall, the limiting protrusion is protruded to the inner surface, the constraining member comprises a second surface facing toward the inner surface of the escutcheon, wherein a first interval is defined between the first surface of the positioning member and inner surface of the lateral wall, and a second interval smaller than the first interval is defined between the second surface of the constraining member and the inner surface of the lateral wall.

15. The lock escutcheon of lock structure in accordance with claim 14, wherein the constraining member comprises a constraining slot recessed from the second surface, and the limiting protrusion of the escutcheon is constrained in the constraining slot.

16. The lock escutcheon of lock structure in accordance with claim 11, wherein the positioning member comprises a first positioning slot, a second positioning slot and a third positioning slot, the second positioning slot is located between the first positioning slot and the third positioning slot, wherein a first curved surface is located between the first positioning slot and the second positioning slot, and a second curved surface is located between the second positioning slot and the third positioning slot, wherein the first curved surface is lower than the second curved surface.

17. The lock escutcheon of lock structure in accordance with claim 16, wherein the limiting protrusion of the escutcheon is rotated toward a first direction via the first curved surface and the second curved surface sequentially to enter the positioning slot.

* * * * *